US008468630B2

(12) United States Patent
Barnhart et al.

(10) Patent No.: US 8,468,630 B2
(45) Date of Patent: Jun. 25, 2013

(54) WHEEL WEIGHT TOOL

(75) Inventors: Russell B. Barnhart, Lexington, NC (US); Kim M. Barnhart, Lexington, NC (US)

(73) Assignee: U.W.T., Inc., Lexington, NC (US)

( * ) Notice: Subject to any disclaimer, the term of this patent is extended or adjusted under 35 U.S.C. 154(b) by 204 days.

(21) Appl. No.: 13/110,064

(22) Filed: May 18, 2011

(65) Prior Publication Data

US 2011/0314614 A1 Dec. 29, 2011

Related U.S. Application Data

(60) Provisional application No. 61/359,026, filed on Jun. 28, 2010.

(51) Int. Cl.
*B25F 1/00* (2006.01)
*B25D 1/14* (2006.01)

(52) U.S. Cl.
USPC ..... 7/143; 81/26

(58) Field of Classification Search
USPC ..... 7/143–147, 161, 166, 170, 100; 81/20–27
See application file for complete search history.

(56) References Cited

U.S. PATENT DOCUMENTS

| | | | | | |
|---|---|---|---|---|---|
| 73,923 | A | * | 1/1868 | Phillips | 7/143 |
| 1,689,585 | A | | 10/1928 | Haschart | |
| 2,274,126 | A | | 2/1942 | Carrigan | |
| 2,314,145 | A | | 3/1943 | Kalajian | |
| D163,533 | S | * | 6/1951 | Mills | D8/81 |
| 2,833,323 | A | * | 5/1958 | Strickland | 81/25 |
| 2,883,153 | A | | 4/1959 | Abbott | |
| D192,721 | S | * | 5/1962 | Mills | D8/81 |
| 3,152,391 | A | | 10/1964 | Bjorn et al. | |
| 3,721,282 | A | * | 3/1973 | Hayes et al. | 81/25 |
| 3,793,656 | A | | 2/1974 | Songer et al. | |
| 3,821,973 | A | * | 7/1974 | Carmien | 81/25 |
| 3,852,839 | A | | 12/1974 | Blessing | |
| 4,393,908 | A | | 7/1983 | Clay | |
| 4,399,978 | A | * | 8/1983 | Moore | 254/26 R |
| 4,607,406 | A | * | 8/1986 | Davis, Jr. | 7/100 |
| 5,044,033 | A | | 9/1991 | Fosberg | |
| 5,743,285 | A | | 4/1998 | Shalkevich | |
| 6,364,031 | B1 | * | 4/2002 | Amicangelo | 173/90 |
| 6,457,384 | B1 | * | 10/2002 | Cox et al. | 81/22 |
| 6,477,922 | B1 | * | 11/2002 | Burnett | 81/22 |
| 6,536,308 | B1 | | 3/2003 | Thorne et al. | |
| 6,598,858 | B2 | * | 7/2003 | Santa Cruz et al. | 254/26 R |
| 7,533,430 | B2 | * | 5/2009 | Moxey | 7/143 |
| 7,950,308 | B2 | * | 5/2011 | Atsumi et al. | 81/26 |
| 8,210,584 | B2 | * | 7/2012 | Hiltz | 294/24 |
| 2006/0010678 | A1 | * | 1/2006 | Parent et al. | 29/525.01 |
| 2006/0021474 | A1 | * | 2/2006 | Burgess | 81/26 |
| 2009/0056504 | A1 | * | 3/2009 | Atsumi et al. | 81/20 |

FOREIGN PATENT DOCUMENTS

| | | |
|---|---|---|
| WO | WO 02/18104 A1 | 3/2002 |

* cited by examiner

*Primary Examiner* — David B Thomas
(74) *Attorney, Agent, or Firm* — Hammer & Associates, P.C.

(57) ABSTRACT

A wheel weight tool includes a handle connected to a hammer head on a first end and having a first hook on a second end. The first hook may be adapted for removing a wheel weight. The hammer head has a soft end and a hard end. The hard end may include a second hook.

21 Claims, 9 Drawing Sheets

WHEEL WEIGHT TOOL

CROSS-REFERENCE TO RELATED APPLICATIONS

This application claims the benefit of and priority to pending U.S. Provisional Patent Application Ser. No. 61/359,026 filed Jun. 28, 2010.

FIELD OF THE INVENTION

The instant invention is directed toward tools for use on wheels like automobile wheels, and more specifically, tools for use with wheel weights utilized on wheels like automobile wheels.

BACKGROUND OF THE INVENTION

Every year millions of small weights are attached to tires by automotive technicians balancing them. Tire balance, also referred to as tire unbalance or imbalance, describes the distribution of mass within an automobile tire and/or the wheel to which it is attached. When the tire rotates, asymmetries of mass cause the wheel to wobble. This wobbling can give rise to ride disturbances, usually vertical and lateral vibrations. It can also result in a wobbling of the steering. The ride disturbance due to unbalance usually increases with speed. Vehicle suspensions can be excited by tire unbalance forces when the speed of the wheel reaches a point that its rotating frequency equals the suspension's resonant frequency. Tires are inspected in factories and repair shops by two methods: static balancers and dynamic balancers. Tires with high unbalance forces are downgraded or rejected. When tires are fitted to wheels at the point of sale, they are measured again, and wheel weights, also known as correction weights, are applied to counteract the combined effect of the tire and wheel unbalance.

Automotive technicians reduce the wobble to an acceptable level when balancing the wheel by adding small wheel weights to the inner and outer wheel rims. A wheel weight is installed by the use of a wheel weight and/or clip that secures the wheel weight to the edge of the wheel. A common garage tool, like a hammer, is typically used to hammer the wheel weight and/or clip down onto the wheel. To remove the wheel weight and/or clip another common garage tool, similar to a pair of pliers or a screw driver, are typically used to grasp and pinch or pry the wheel weight and/or clip to remove the wheel weight.

Traditionally, wheel weights have been made of lead. However, to reduce environmental concerns, steel and zinc weights are being used more frequently. These steel and zinc weights are coated or non-coated. The coated weights have a coating on them which have been discovered to chip or scratch during the installation or removal of the wheel weight by standard wheel weight tools. In addition to the problem with the wheel weight chipping or scratching during installation and removal, the actual wheels themselves (or coatings on the wheels) have been discovered to chip and or scratch around its edges during installation or removal of the wheel weight with standard wheel weight tools. As should be understood these chipped and/or scratched portions of the wheel and/or wheel weights are undesirable for vehicle owners.

It is thus highly desirable to create a wheel weight tool for installing and/or removing wheel weights that may be easier to use than common garage tools and may reduce or prevent chips and/or scratches on the wheel weight and/or wheel itself.

The instant invention is designed to address the above mentioned problems.

DESCRIPTION OF DRAWINGS

For the purpose of illustrating the invention, there is shown in the drawings a form that is presently preferred; it being understood, however, that this invention is not limited to the precise arrangements and instrumentalities shown.

SUMMARY OF THE INVENTION

The instant invention is directed toward a wheel weight tool. The wheel weight tool includes a handle connected to a hammer head on a first end and having a first hook on a second end. The first hook may be adapted for removing a wheel weight. The hammer head has a soft end and a hard end. The hard end may include a second hook.

DETAILED DESCRIPTION OF THE DRAWINGS

Figure 1:
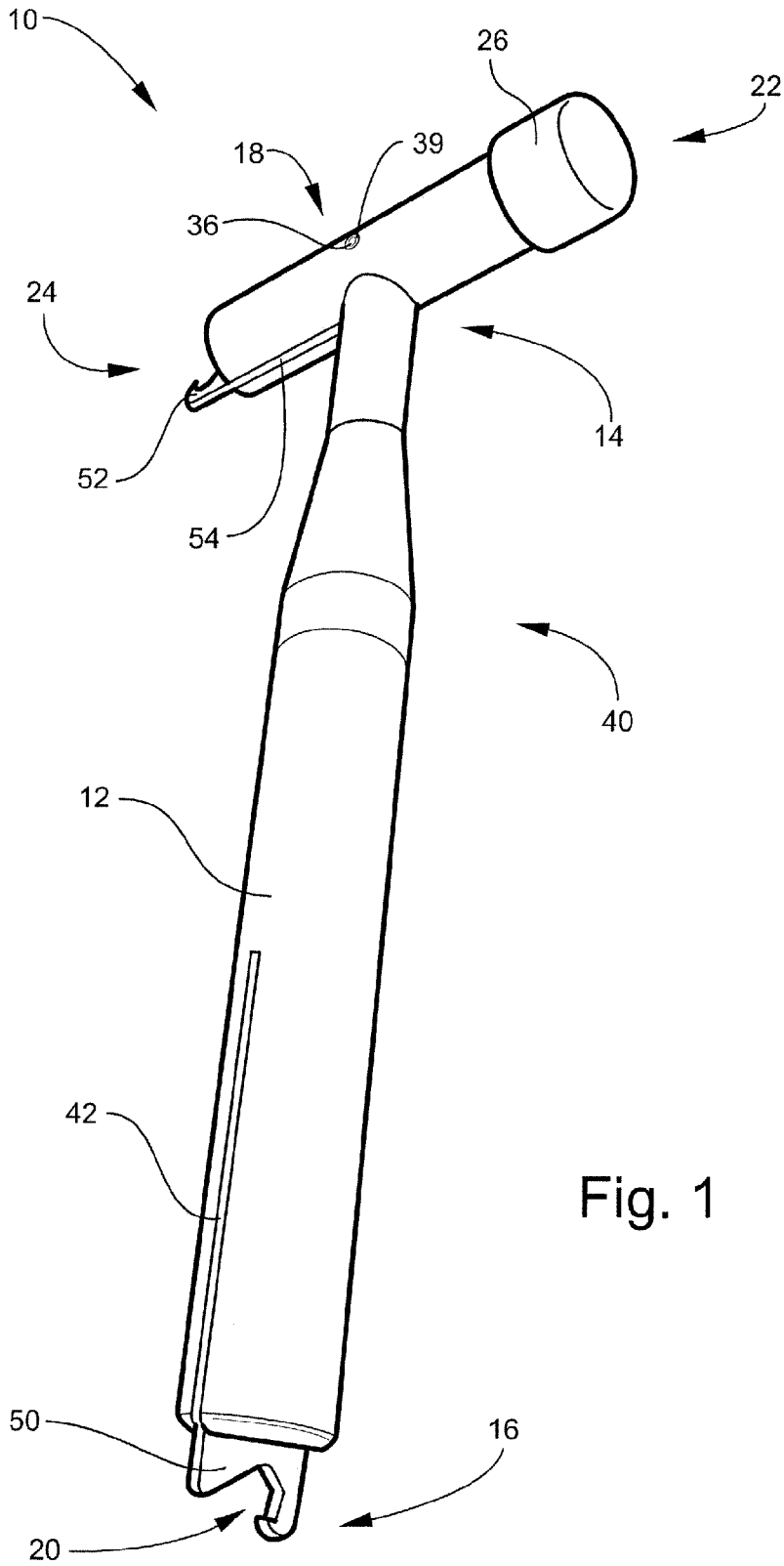
FIG. 1 shows a perspective view of one embodiment of the wheel weight tool according to the instant invention.
Figures 2, 3:
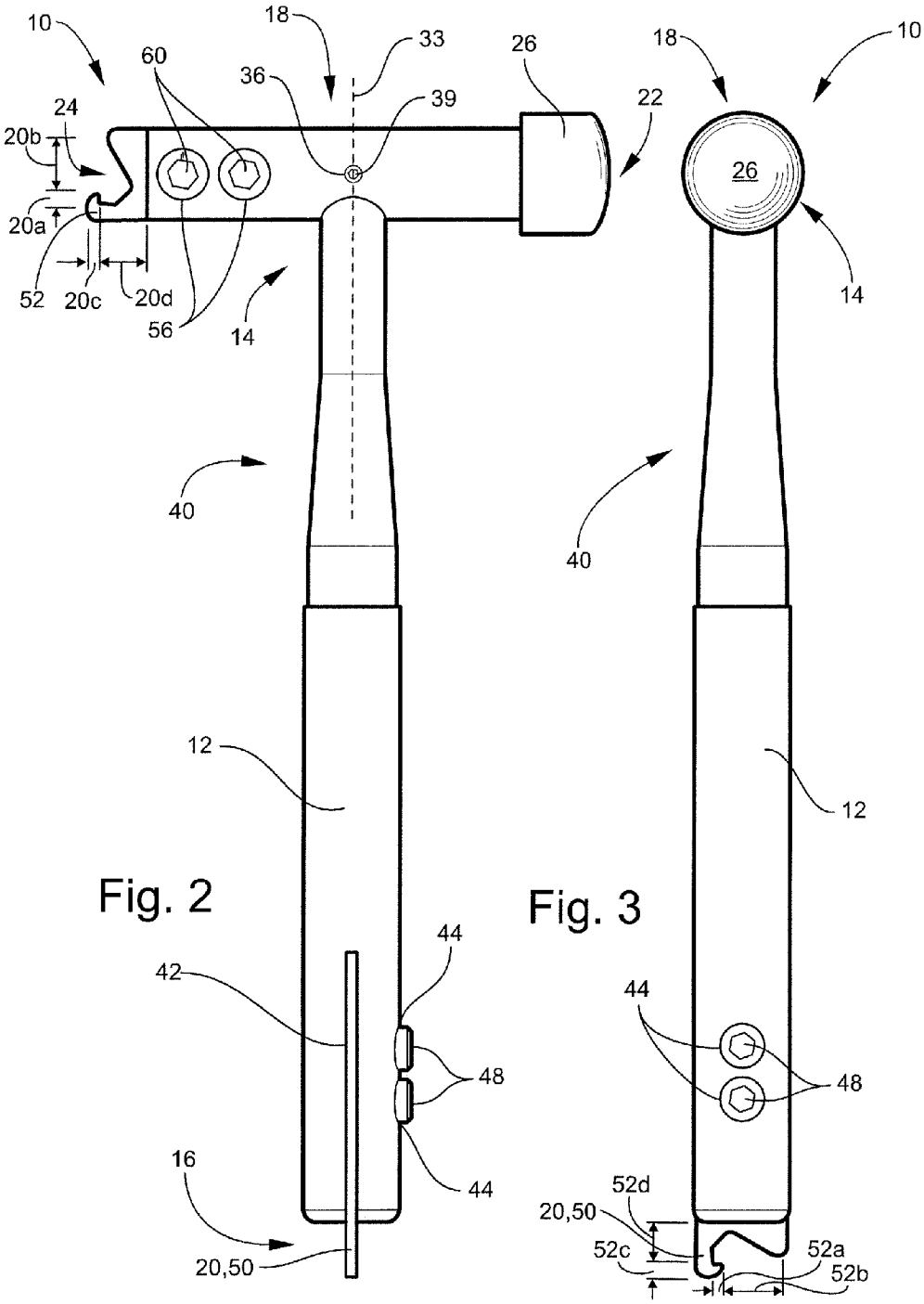
FIG. 2 shows a front view of the wheel weight tool from FIG. 1.
FIG. 3 shows a first side view of the wheel weight tool from FIG. 1 of the side with the soft end.
Figure 4:
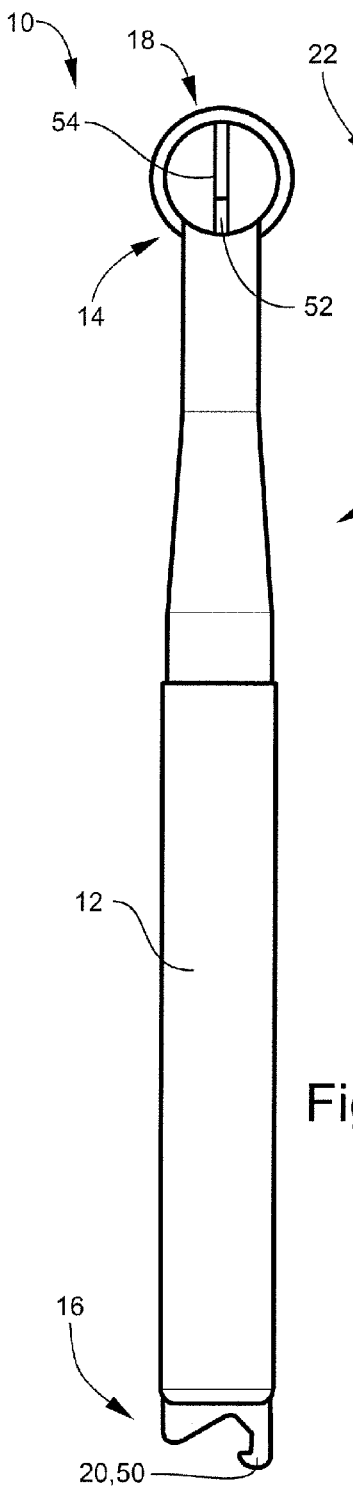
FIG. 4 shows a second side view of the wheel weight tool from FIG. 1.
Figure 5:
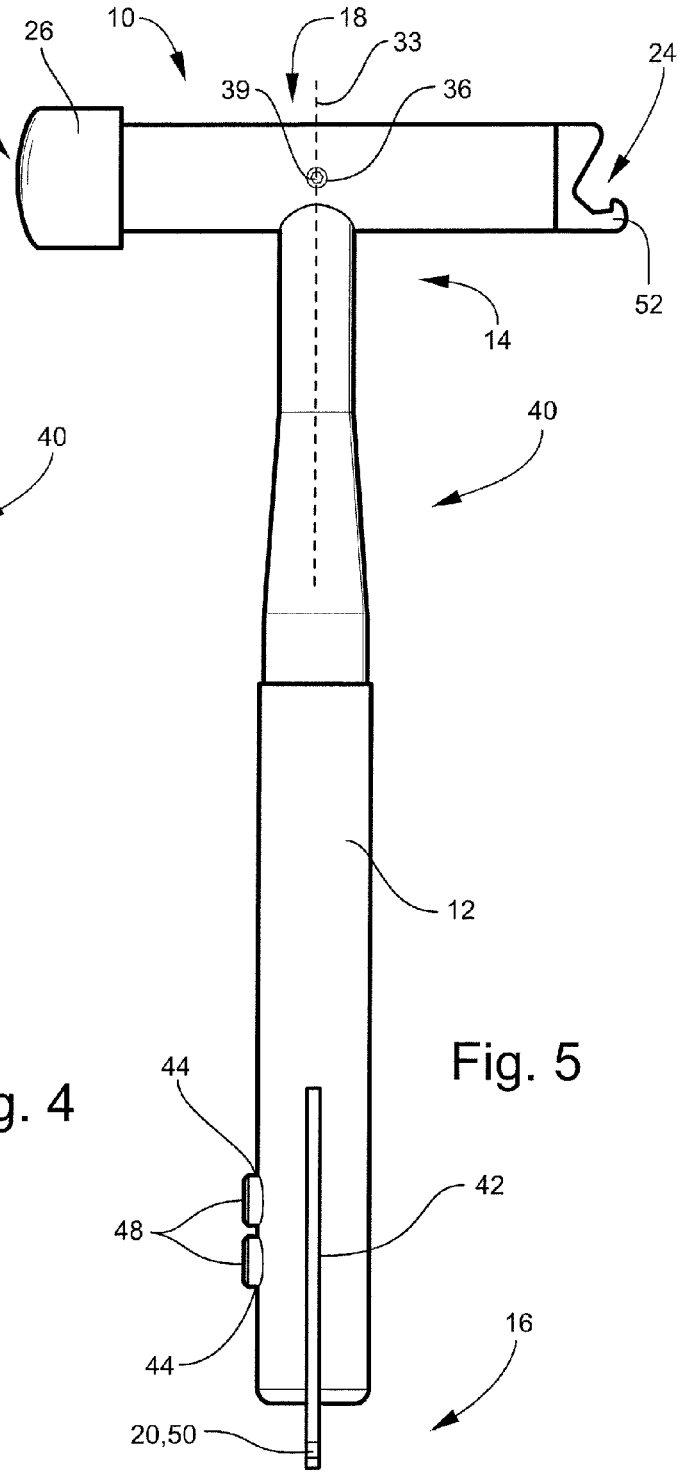
FIG. 5 shows a back view of the wheel weight tool from FIG. 1.
Figure 6:
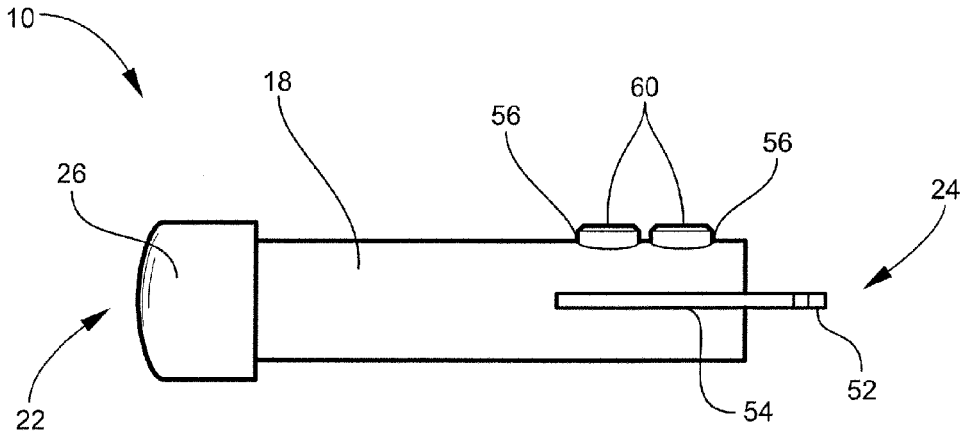
FIG. 6 shows a top view of the wheel weight tool from FIG. 1.
Figure 7:
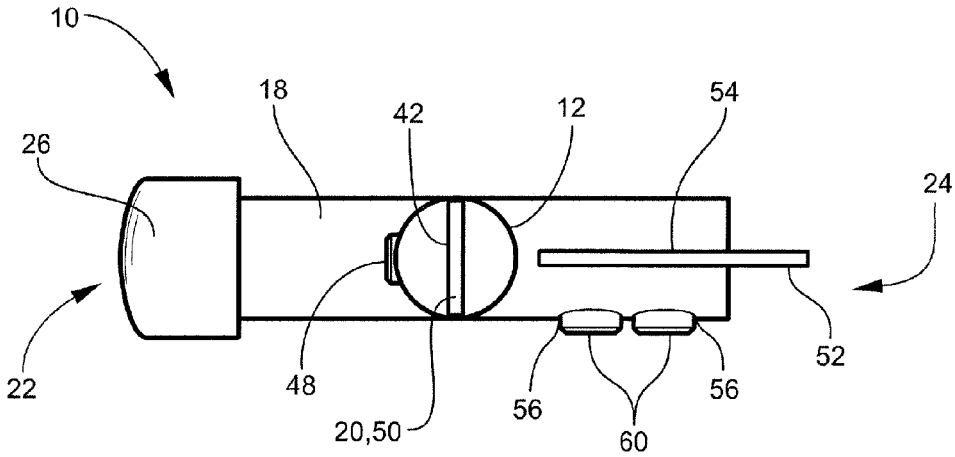
FIG. 7 shows a bottom view of the wheel weight tool from FIG. 1.

Referring to the drawings, wherein like numerals indicate like elements, there is shown in FIG. 1 an embodiment of a wheel weight tool 10. Wheel weight tool 10 may be for use by automobile technicians in installing and removing wheel weights from wheels like automobile wheels. However, the invention is not so limited, and wheel weight tool 10 may be utilized for other purposes by automobile technicians and other mechanical uses outside of the automobile field. Wheel weight tool 10 may generally include a handle 12, a hammer head 18, and a first hook 20. These parts and other optional parts will be described in greater detail below.

Handle 12 may be included in wheel weight tool 10. See FIGS. 1-10. Handle 10 may be for providing the main body and handle of tool 10. Handle 12 may have hammer head 18 connected to a first end 14 and a first hook 20 on a second end 16. Handle 10 may be any desired size and shape. Handle 12 may have any length. In one embodiment, handle 12 may have a length of between 5 and 20 inches. In another embodiment, handle 12 may have a length of approximately 10 inches. In yet another embodiment, handle 12 may have a length of 9.5 inches. In one embodiment, handle 12 may have a cylindrical shape with a circular cross-section. In this embodiment, handle 12 may have any size radius. In one embodiment, the radius of handle 12 may be between 0.2 and 5 inches. In another embodiment, the radius of handle 12 may be between 0.5 and 1 inch. The cross-section of the cylindrical shape may be constant or may be irregular with varying cross-sections.

In one embodiment, handle 10 may have a circular cross-section with a tapered section 40. Tapered section 40 may reduce the radius of the handle 12 approximate to the hammer head 18. Tapered section 40 may reduce the radius of handle 12 approximate to the hammer head 18 by any amount. In one embodiment, tapered section 40 may reduce the radius of handle 12 approximate to the hammer head 18 by between 20-50%. In another embodiment, tapered section 40 may reduce the radius of handle 12 approximate to the hammer head 18 by approximately 64%. For example, handle 12 may have a radius of approximately 0.975 inches, and tapered section 40 may reduce the radius of handle 12 approximate to hammer head 18 to approximately 0.625 inches. Tapered section 40 may also have any desired length. For example, the length of tapered section 40 may be approximately 1.5 inches.

Handle 12 may be made out of any desired material. In one embodiment, handle 12 may be made out of an aluminum material. The aluminum material may be any desired aluminum, including, but not limited to, 6061 aluminum.

Figure 8:
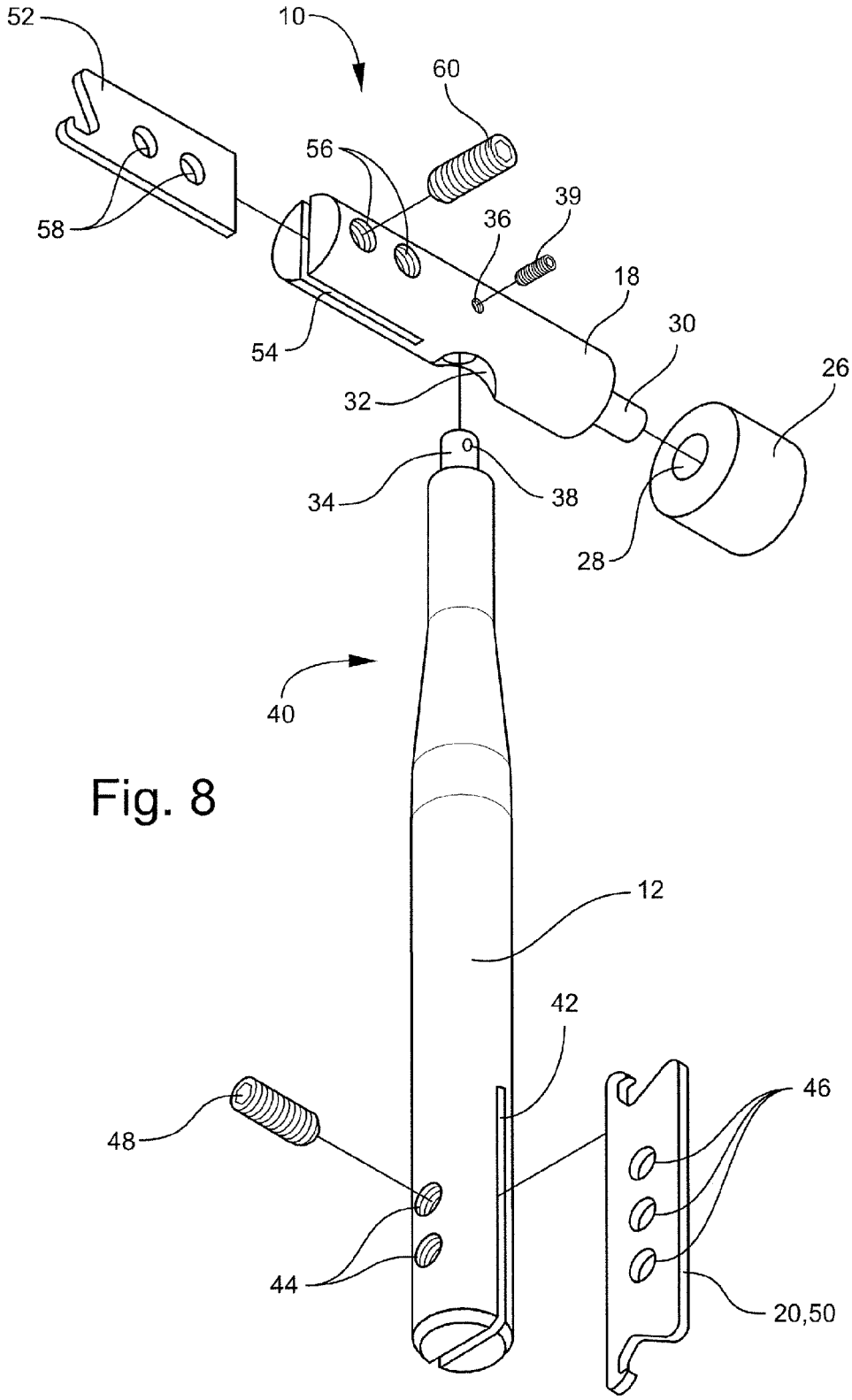
FIG. 8 shows a blown up perspective view of the wheel weight tool from FIG. 1.

Hammer head 18 may be attached to the first end 14 of handle 12 in wheel weight tool 10. See FIGS. 1-10. Hammer head 18 may be for providing a hammer head on handle 12. Hammer head 18 may be any desired shape or size of a hammer head. Hammer head 18 may have a soft end 22. For example, hammer head 18 may be for hammering a wheel weight onto a wheel utilizing soft end 22. Hammer head 18 may also include a hard end 24 that may optionally include a second hook 52. As another example, hammer head 18 may be utilized for removing wheel weights with hard end 24 via second hook 52. Hard end 24 may also not include second hook 52, where hard end 24 may be used as a standard hammer head. Hammer head 18 may be attached to handle 12 by any means. In one embodiment, as shown in FIG. 8, hammer head 18 may have a first head hole 32 approximate to its longitudinal center 33. In this embodiment, handle 12 may have a handle cylinder 34 protruding from the first end 14. The handle cylinder 34 may be adapted to fit inside of the first head hole 32. To hold the first head hole 32 on the handle cylinder 34, the hammer head may have a second head hole 36 perpendicular to the first head hole 32, and the handle cylinder 34 may have a cylinder hole 38. The cylinder hole 38 may be adapted to align with the second head hole 36, whereby a roll pin 39 (or other similar device) may be inserted through the hammer head 18 and handle cylinder 34 for attaching the hammer head 18 to the handle 12. The roll pin 39 may be any type of roll pin and may be made out of any material, including, but not limited to, being made of steel, like 3/16 steel.

Hammer head 18 may be made out of any desirable material. In one embodiment, hammer head 18 may be made out of steel. The hammer head steel may be any desired steel including, but not limited to, 1018 steel.

Soft end 22 may be included on hammer head 18 of wheel weight tool 10. See FIGS. 1-10. Soft end 22 may be for providing a soft hammering surface, i.e., a hammering surface that will not chip or scratch metal and alloy surfaces. Soft end 22 may be any type of soft hammering surface. In one embodiment, soft end 22 may have a soft cap 26. Soft cap 26 may be made of any soft material, including, but not limited to, being made of nylon. Soft cap 26 may be integrally built onto hammer head 18 or it may be removable. Having soft cap 26 removable from hammer head 18 may allow soft cap 26 to be replaceable when it becomes damages, warn, torn, etc. The removable soft cap 26 may be attached to hammer head 18 by any means. In one embodiment, as shown in FIG. 8, soft cap 26 may include a cap hole 28 adapted to be inserted onto a head cylinder 30. Head cylinder 30 may be protruding from soft end 22 of hammer head 18. In this embodiment, cap hole 28 may be dimensioned slightly smaller than head cylinder 30, whereby, frictional forces may maintain soft cap 26 on hammer head 18.

The first hook 20 may be included on the second end 16 of handle 12 in wheel weight tool 10. First hook 20 may be utilized by automobile technicians (or any person) for removing wheel weights from automobile wheels. First hook 20 may be attached to handle 12 at second end 16 by any means. In one embodiment, first hook 20 may be inserted through a handle slot 42 in the second end 16 of the handle 12. First hook 20 may be held in handle slot 42 by any means. In one embodiment, first hook 20 may be held in handle slot 42 by including a plurality of handle threaded holes 44 perpendicular to the handle slot 42. In this embodiment, the first hook 20 may have a corresponding amount of first hook holes 46 adapted to align with the plurality of handle threaded holes 44, whereby a plurality of first hook screws 48 may hold the first hook 20 in the handle slot 42. First hook 20 may have any dimensions adapted for removing a wheel weight, i.e., the first hook 20 may be dimensioned to grip wheel weight clip 63 via wheel weight clip hole 64. See FIG. 10. In one embodiment, first hook 20 may have a height 20*a*, a clearance height 20*b*, a width 20*c*, and a clearance width 20*d*. Height 20*a* may be any height including, but not limited to between 0.2 inches and 1 inch, or between 0.4 inches and 0.6 inches, or approximately 0.5 inches. Clearance height 20*b* may be any height including, but not limited to between 0.5 inches and 1.5 inches, or between 0.7 inches and 0.9 inches, or approximately 0.8 inches. Width 20*c* may be any width including, but not limited to between 0.005 inches and 0.100 inches, or between 0.010 inches and 0.050 inches, or approximately 0.032 inches. Clearance width 20*d* may be any width including, but not limited to between 0.05 inches and 0.10 inches, or between 0.1 inches and 0.3 inches, or approximately 0.21 inches. First hook 20 may be a simple one sided hook, or it may also be a two-sided hook 50, as shown in FIG. 8. Two sided hook 50 may allow a user to rotate sides once one side of the hook become warn or damaged. In addition, two sided hook 50 may be configured with two different sized hooks where a user may rotate the hooks to fit different sized wheel weights and clips.

In one embodiment of wheel weight tool 10, the hard end 24 of hammer head 18 may include a second hook 52. Second hook 52 may be utilized similar to first hook 20 where automobile technicians (or any person) may use the hook for removing wheel weights from automobile wheels. Second hook 52 may be attached to hammer head 18 at hard end 24 by any means. In one embodiment, second hook 52 may be inserted through a hammer head slot 54 in the hard end 24 of the hammer head 18. Second hook 52 may be held in hammer head slot 54 by any means. In one embodiment, second hook 52 may be held in hammer head slot 54 by including a plurality of hammer head threaded holes 56 perpendicular to the hammer head slot 54. In this embodiment, the second hook 52 may have a corresponding amount of second hook holes 58 adapted to align with the plurality of hammer head threaded holes 56, whereby a plurality of second hook screws 60 may hold the second hook 52 in the hammer head slot 54. Second hook 52 may have any dimensions adapted for removing a wheel weight, i.e., the second hook 52 may be dimensioned to grip wheel weight clip 63 via wheel weight clip hole 64. See FIG. 10. In one embodiment, second hook 52 may have a height 52*a*, a clearance height 52*b*, a width 52*c*, and a clearance width 52*d*. Height 52*a* may be any height including, but not limited to between 0.2 inches and 1 inch, or between 0.4 inches and 0.6 inches, or approximately 0.5 inches. Clearance height 52*b* may be any height including, but not limited to between 0.5 inches and 1.5 inches, or between 0.7 inches and 0.9 inches, or approximately 0.8 inches. Width 52*c* may be any width including, but not limited to between 0.005 inches and 0.100 inches, or between 0.010 inches and 0.050 inches, or approximately 0.032 inches. Clearance width 52*d* may be any width including, but not limited to between 0.05 inches and 0.10 inches, or between 0.1 inches and 0.3 inches, or approximately 0.21 inches. Second hook 52 may be dimensioned similar to first hook 20 or it may be designed with different dimensions to fit different sized wheel weights 62 and wheel weight clips 63.

First hook 20 and second hook 52 may be made out of any material adapted for removing wheel weights. In one embodiment, first hook 20 and second hook 52 may be made out of a steel material, including but not limited to, a heat treated steel.

Figure 9:
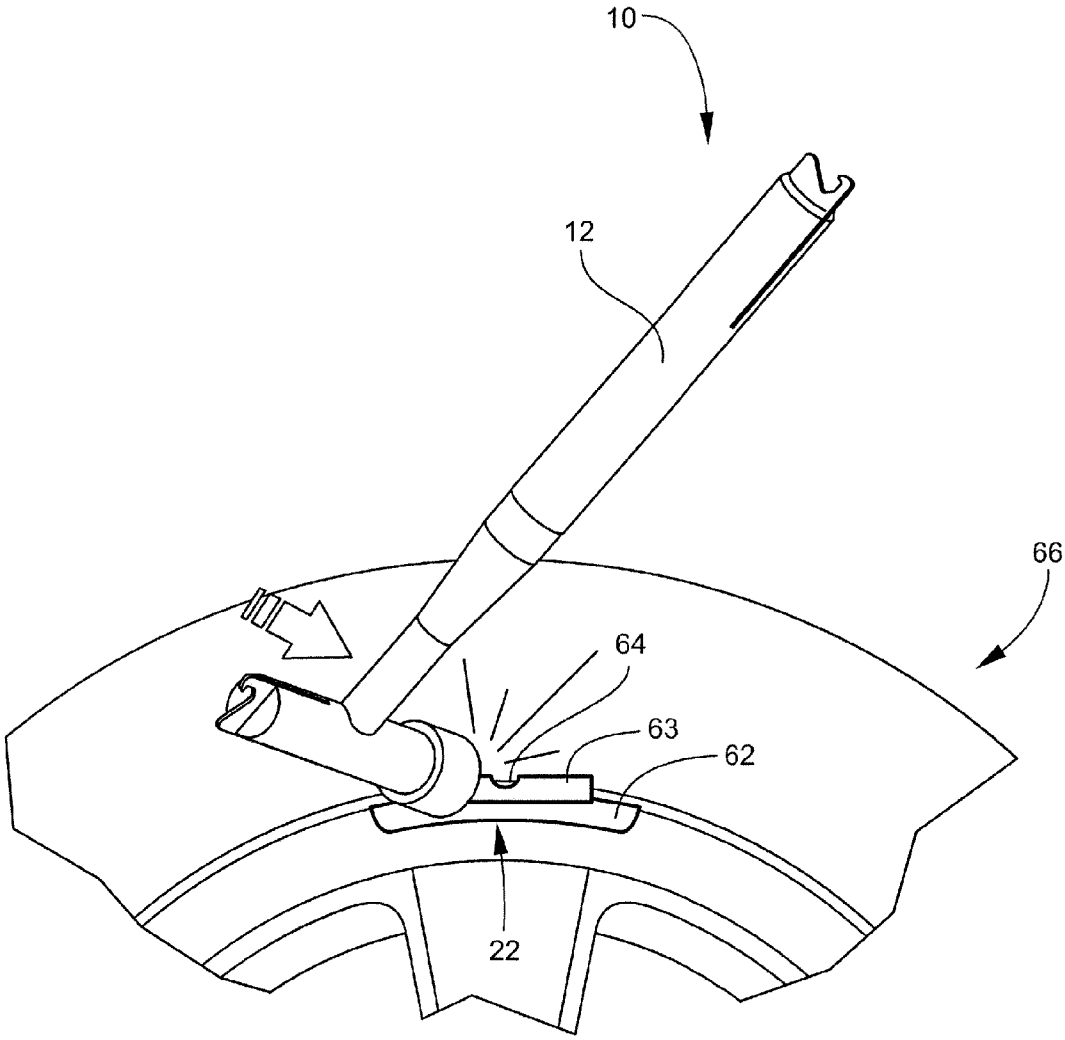
FIG. 9 shows an environmental view of the wheel weight tool from FIG. 1 being used to install a wheel weight.
Figure 11:
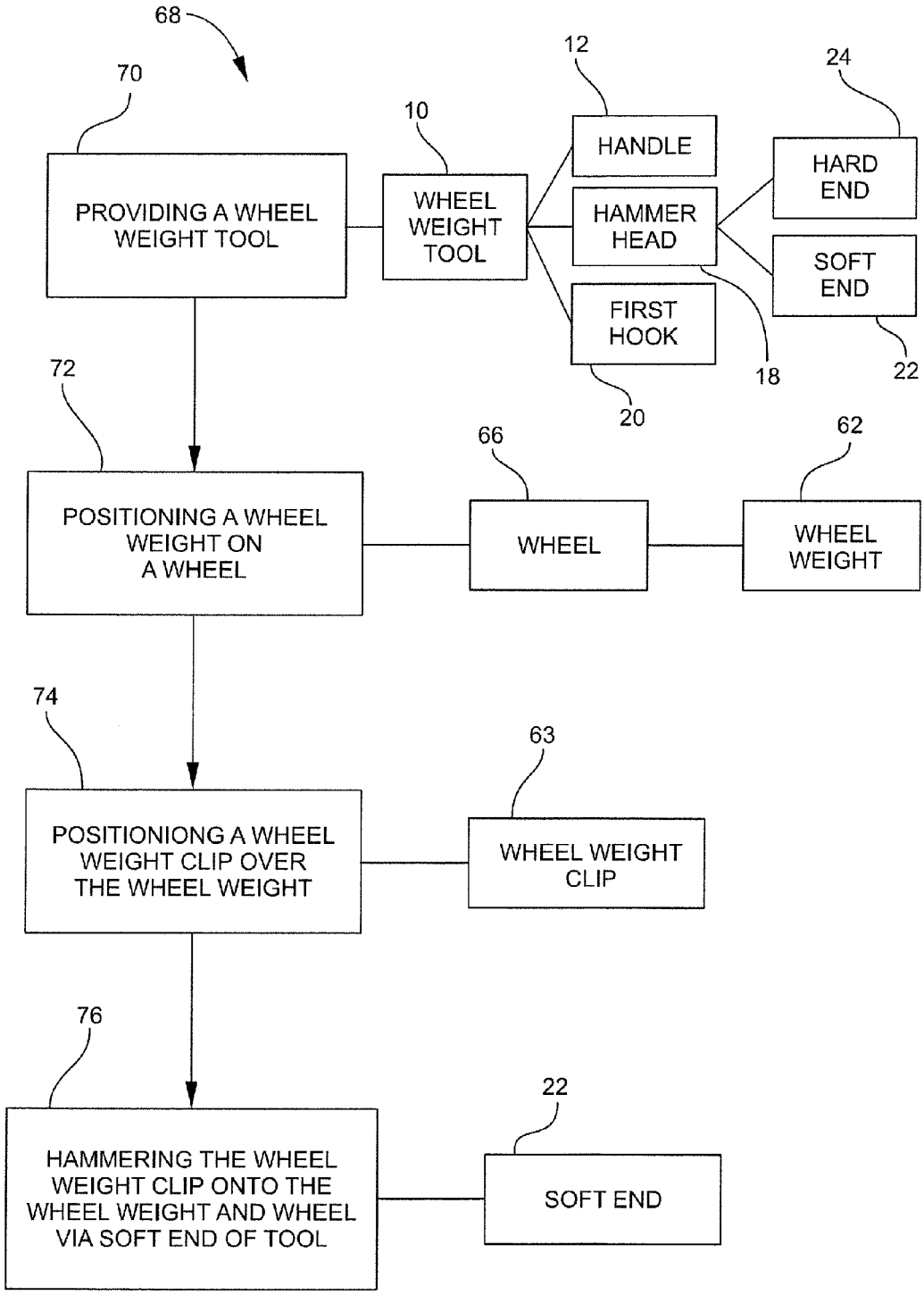
FIG. 11 shows a flow diagram of one embodiment of the method of installing a wheel weight according to the instant invention.

Referring to FIGS. 9 and 11, the instant invention also includes a method 68 of installing wheel weights. Method 68 may be for utilizing wheel weight tool 10 to install a wheel weight 62 onto a wheel 66 utilizing a wheel weight clip 63, as shown in FIG. 9. Method 68 may include any steps for utilizing wheel weight tool 10 to install wheel weights. In one embodiment, method 68 of installing wheel weights may include, but is not limited to, the following general steps: a step 70 of providing wheel weight tool 10, as described above; a step 72 of placing a wheel weight 62 on a wheel 66; a step 74 of placing a wheel weight clip 63 over the wheel weight 62; and a step 76 of hammering the wheel weight clip 63 onto the wheel weight 62 via the soft end 22 of wheel weight tool 76.

Figure 10:
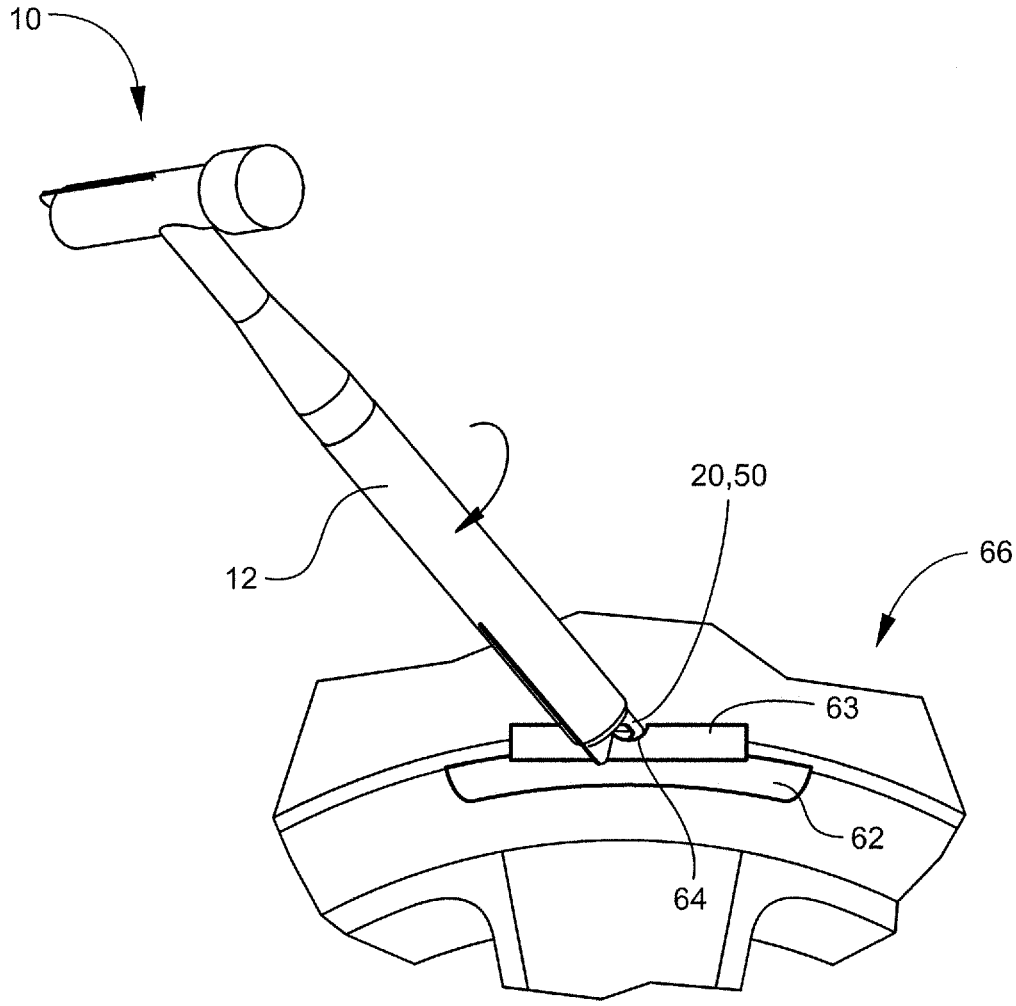
FIG. 10 shows another environmental view of the wheel weight tool from FIG. 1 being used to remove a wheel weight.
Figure 12:
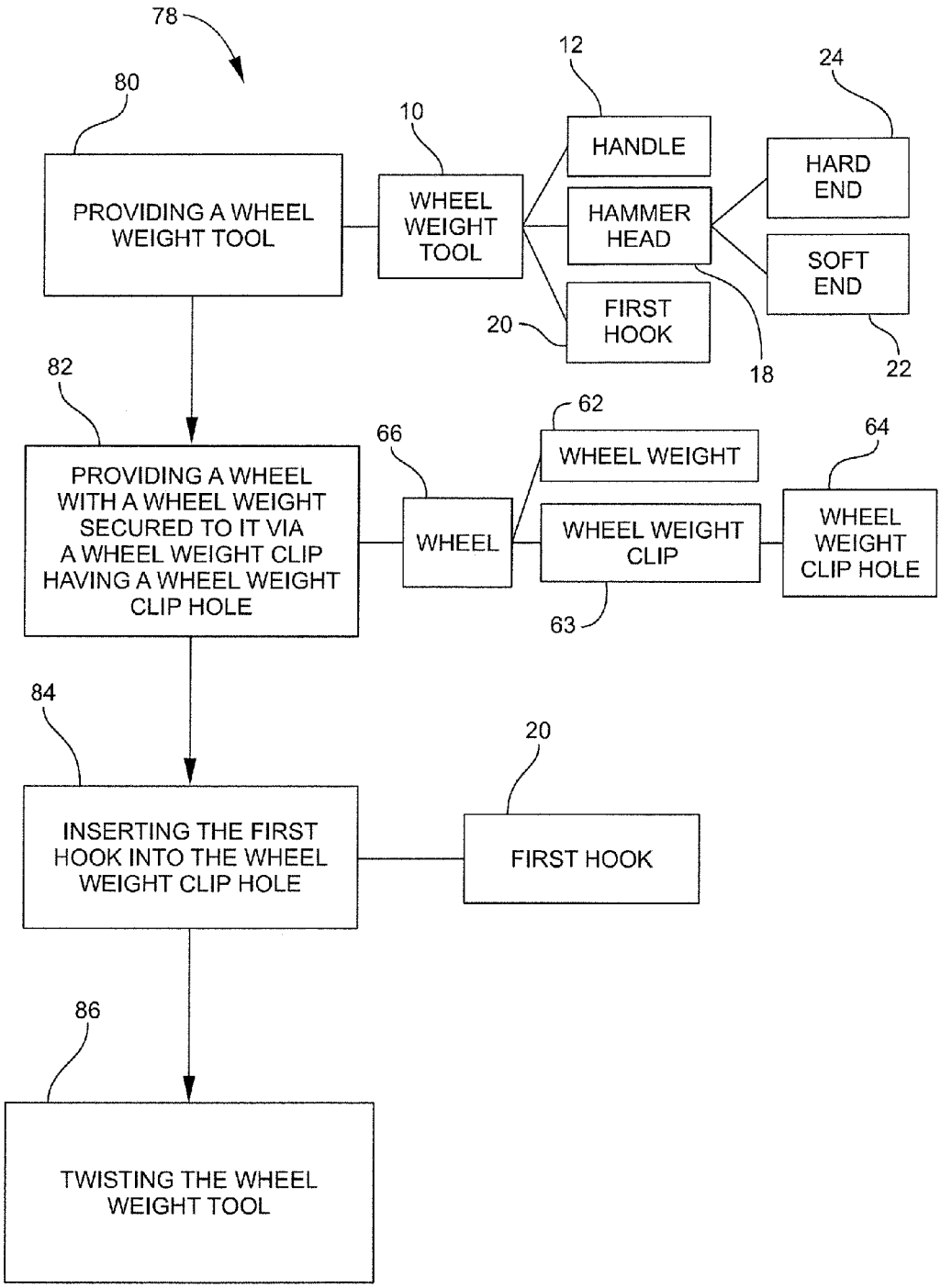
FIG. 12 shows a flow diagram of one embodiment of the method of removing a wheel weight according to the instant invention.

Referring to FIGS. 10 and 12, the instant invention also includes a method 78 of removing wheel weights. Method 78 may be for utilizing wheel weight tool 10 to remove a wheel weight 62 with a wheel weight clip 63 from a wheel 66, as shown in FIG. 10. Method 78 may include any steps for utilizing wheel weight tool 10 to remove wheel weights and wheel weight clips. In one embodiment, method 78 of removing wheel weights may include, but is not limited to, the following general steps: a step 80 of providing a wheel weight tool 10, as described above; a step 82 of providing a wheel 66 with a wheel weight 62 secured to it via a wheel weight clip 63 having a wheel weight clip hole 64; a step 84 of inserting the first hook 20 (or second hook 52) into the wheel weight clip hole 64 of the installed wheel weight 62; and a step 86 of twisting the wheel weight tool 10.

The present invention may be embodied in other forms without departing from the spirit and the essential attributes thereof, and, accordingly, reference should be made to the appended claims, rather than to the foregoing specification, as indicated in the scope of the invention.

We claim:

1. A wheel weight tool comprising:

a handle connected to a hammer head on a first end and having a first hook on a second end;

said handle having a tapered section reducing the radius of said handle approximate to said hammer head;

said first hook being adapted for removing a wheel weight; and said hammer head having a soft end and a hard end.

2. The wheel weight tool of claim 1 where said soft end of said hammer head having a soft cap.

3. The wheel weight tool of claim 2 where said soft cap being made of nylon.

4. The wheel weight tool of claim 2 where said soft cap including a cap hole adapted to be inserted onto a head cylinder protruding from said soft end of said hammer head.

5. The wheel weight tool of claim 4 where said cap hole being dimensioned slightly smaller than said head cylinder, whereby, frictional forces maintaining said soft cap on said hammer head.

6. The wheel weight tool of claim 1 where said hammer head being made of steel, where said steel being 1018 steel.

7. The wheel weight tool of claim 1 where said hammer head having a first head hole approximate to its longitudinal center, and said handle having a handle cylinder protruding from said first end adapted to fit inside of said first head hole.

8. The wheel weight tool of claim 7 where said hammer head having a second head hole perpendicular to said first head hole, and said handle cylinder having a cylinder hole adapted to align with said second head hole, whereby a roll pin may be inserted through said hammer head and handle cylinder for attaching said hammer head to said handle.

9. The wheel weight tool of claim 8 where said roll pin being made of steel, where said roll pin steel having a 3/16 diameter.

10. The wheel weight tool of claim 1 where said handle being made of aluminum.

11. The wheel weight tool of claim 1 where said first hook being inserted through a handle slot in the second end of said handle.

12. The wheel weight tool of claim 11 where said handle including a plurality of handle threaded holes perpendicular to said handle slot, and said first hook having a corresponding amount of first hook holes adapted to align with said handle threaded holes, whereby a plurality of first hook screws may hold said first hook in said handle slot.

13. The wheel weight tool of claim 1 where said first hook being a two-sided hook.

14. The wheel weight tool of claim 1 wherein said hard end of said hammer head including a second hook.

15. The wheel weight tool of claim 14 where said second hook being inserted through a hammer head slot in the hard end of said hammer head.

16. The wheel weight tool of claim 15 where said hammer head including a plurality of hammer head threaded holes perpendicular to said hammer head slot, and said second hook having a corresponding amount of second hook holes adapted to align with said hammer head threaded holes, whereby a plurality of second hook screws may hold said second hook in said hammer head slot.

17. The wheel weight tool of claim 14 where said first and second hooks being made of heat treated steel.

18. A method of installing wheel weights comprising the steps of:

providing a wheel weight tool comprising:

a handle connected to a hammer head on a first end and having a first hook on a second end;

said handle having a tapered section reducing the radius of said handle approximate to said hammer head;

said first hook being adapted for removing a wheel weight; and said hammer head having a soft end and a hard end;

positioning a wheel weight on a wheel;

positioning a wheel weight clip over the wheel weight; and hammering the wheel weight clip onto the wheel weight and wheel via the soft end of said wheel weight tool.

19. A method of removing wheel weights comprising the steps of:

providing a wheel weight tool comprising:

a handle connected to a hammer head on a first end and having a first hook on a second end;

said first hook being adapted for removing a wheel weight; and said hammer head having a soft end and a hard end;

providing a wheel with a wheel weight secured to it via a wheel weight clip having a wheel weight clip hole;

inserting the first hook into the wheel weight clip hole; and twisting said wheel weight tool.

20. A wheel weight tool comprising:

a handle connected to a hammer head on a first end and having a first hook on a second end;

said first hook being adapted for removing a wheel weight;

said first hook being inserted through a handle slot in the second end of said handle; and said hammer head having a soft end and a hard end.

21. A wheel weight tool comprising:

a handle connected to a hammer head on a first end and having a first hook on a second end;

said first hook being adapted for removing a wheel weight;

said hammer head having a soft end and a hard end;

said hard end of said hammer head including a second hook; and said second hook being inserted through a hammer head slot in the hard end of said hammer head.

* * * * *